US005092763A

United States Patent [19]

Winiger

[11] Patent Number: 5,092,763

[45] Date of Patent: Mar. 3, 1992

[54] NON-REFILLABLE GAS LIGHTER

[75] Inventor: A. Winiger, Morbio-Inf., Switzerland

[73] Assignee: Interflame Aktiengesellschaft, Liechtenstein, Fed. Rep. of Germany

[21] Appl. No.: 523,551

[22] Filed: May 15, 1990

[30] Foreign Application Priority Data

May 30, 1989 [CH] Switzerland ..... 02021/89

[51] Int. Cl.[5] ..... F23Q 1/02

[52] U.S. Cl. ..... 431/276; 431/344

[58] Field of Search ..... 431/276, 277, 344, 254, 431/150, 143

[56] References Cited

U.S. PATENT DOCUMENTS 2,620,643 12/1952 Hissen ..... 431/150
3,148,522 9/1964 Court ..... 431/254
3,388,962 6/1968 Baumann et al. ..... 431/344
3,819,320 6/1974 Chevallier ..... 431/254
4,235,589 11/1980 Vallera ..... 431/143

*Primary Examiner*—Carroll B. Dority
*Attorney, Agent, or Firm*—Spencer & Frank

[57] ABSTRACT

A non-refillable gas lighter includes a member made of dry powdered metal and having a gas throughput according to the limited height of flame inserted in the flow route of the gas in the burner body upstream of the burner mouth which can be closed by a valve tappet. A helicoidal spring is disposed in an area of a push-buttom and a flint. One projecting end of the spring grips under the flint and presses the flint against a sparking wheel and another projecting end of the spring grips operatively in closing-direction on the push-button.

2 Claims, 1 Drawing Sheet

NON-REFILLABLE GAS LIGHTER

BACKGROUND OF THE INVENTION

The present invention relates to a non-refillable gas lighter, comprising a burner valve arrangement, the burner body thereof being in flow-connection via a rising main or wick with the liquid gas reservoir and interacting with a valve tappet which is operable in a closing-direction by means of a spring-loaded push-button or lever.

A considerable problem with such non-refillable gas lighters is first of all the safety requirement, to limit the height of flame to a specified maximum. Diaphragms and suchlike means provided for this purpose for such non-refillable gas lighters have been too complicated and costly and not precise enough in the limiting-quality thereof.

A second problem with such non-refillable gas lighters exists, furthermore, in the complicated conception thereof, which is contradicting to the requirement of least expenditure in the mass production of such lighters.

SUMMARY OF THE INVENTION

Therefore, a primary object of the present invention is to take steps that permit with least expenditure an optimum limiting and constancy of the height of flame.

A second object of the invention is, furthermore, to reduce the parts used in such non-refillable gas lighters.

The optimum limiting and constancy of the height of flame is achieved according to the invention by a member made of dry powdered metal and having a gas throughput according to the limited height of a flame being inserted in the flow route of the gas in the burner body upstream of the burner mouth which can be closed by the valve tappet.

In the case of a non-refillable gas lighter of the preceding kind, comprising a burner valve arrangement operable by means of a spring-loaded push-button or lever as well as a sparking or ignition wheel that can be rotated against the effect of a spring loaded flint, a reduction of the constructional expenditure is thus achieved by a helicoidal spring being disposed in the area of the push-button and the flint which with the one projecting end thereof grips under the flint and presses said flint against the sparking wheel and which with the other projecting end, grips operatively in closing-direction on the push-button.

As a result of these steps, springs heretofore employed for the press-button as well as also for the flint can hence be disposed with, which means, particularly in the case of mass produced articles, a significant simplification with all the advantages connected therewith.

BRIEF DESCRIPTION OF THE DRAWING

Embodiment examples according to the invention will now be described more particularly with reference to the accompanying drawings, wherein.

DETAILED DESCRIPTION OF THE PREFERRED EMBODIMENTS

Figure 1:
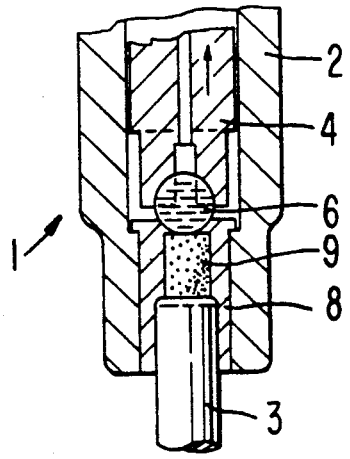
FIG. 1 shows in a partial longitudinal cross-section, the burner valve arrangement in a gas lighter.
Figure 2:
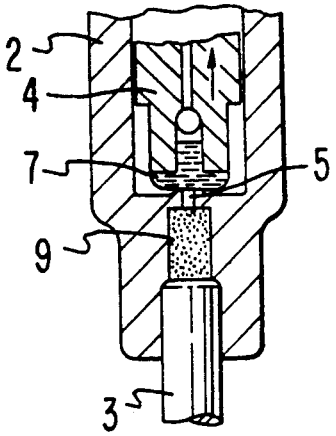
FIG. 2 shows a variant embodiment of the arrangement as defined in FIG. 1.

The non-refillable gas lighter (not indicated more closely) as illustrated in FIGS. 1 or 2 comprises a burner valve arrangement 1, the burner body 2 thereof being in customary manner in flow connection via a rising main 3 with a liquid gas reservoir (not shown in detail). The technology required to connect the casing, reservoir and burner can be presupposed as known, so that further explanation is redundant.

Figure 3:
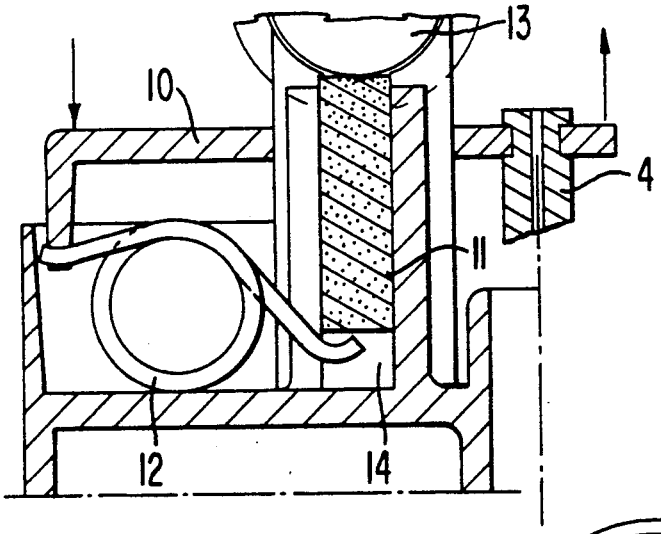
FIG. 3 shows in a partial longitudinal cross-section, the valve actuation arrangement and the sparking arrangement in a gas lighter.

The burner body 2 interacts in customary manner with a valve tappet 4 which is operable (liftable) a closing-direction by means of a spring-loaded push-button or lever (FIG. 3).

The burner mouth 5 may be closed in a customary manner by means of a rubber ball 6 or rubber mushroom 7 (FIG. 2) or rubber disc.

In accordance with the invention, a member 9 made of dry powdered metal and having a gas throughput according to the limited height of flame is inserted in the flow route of the gas in the burner body 2 or in a pre mountable sleeve up-stream of the burner mouth 5 which can be closed by the valve tappet 4.

As a result of these steps, a burner valve arrangement for gas lighters is attained, the means for limiting the height of flame thereof being, by comparison to the known prior art, very simple to manufacture and thus renders possible a constancy of practically any desired pre-selectable maximum height of flame not achievable heretofore.

Figure 4:
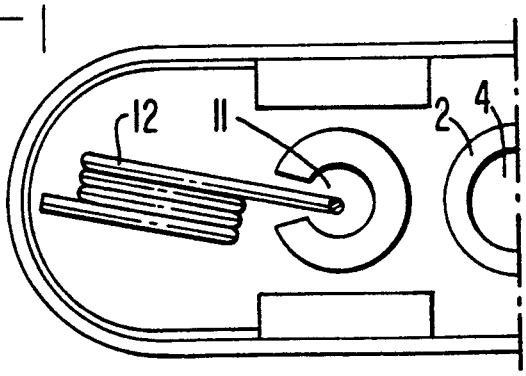
FIG. 4 is the arrangement of FIG. 3 shown in a top view with the press-button and sparking wheel removed.

In accordance with the embodiments in FIGS. 3 and 4, such a non-refillable gas lighter comprises, apart from the push-button 10 already mentioned, a sparking wheel 13 that can be rotated against the effect of a spring-loaded flint 11.

According to the invention, a helicoidal spring 12 is hence disposed in the area of the push-button 10 and the flint 11 which with the one projecting end thereof grips under the flint 11 and presses said flint against the sparking wheel 13 and which with the other projecting end, grips operatively in closing-direction on the push-button 10.

Hence, it follows from the foregoing that the steps according to the invention may be put into effect in practically all known gas-lighter systems, independent of the sparking means and burner-actuating means employed.

While there are shown and described preferred embodiments of the invention, it is to be distinctly understood that the invention is not limited thereto but may be embodied and practised within the scope of the following claims. Accordingly,

What I claim is:

1. A non-refillable gas lighter, comprising:

a liquid gas reservoir including gas outlet means for releasing gas from said reservoir;

a burner body defining a flow channel having a mouth which is in flow communication with said gas outlet means;

a valve tappet disposed in said flow channel;

a helicoidal spring having first and second ends;

a spring-loaded push-button connected at one end with said valve tappet, and means mounting push button for displacing said valve tappet for selectively opening and closing the mouth of said flow channel with respect to said gas outlet means, said spring-loaded push-button engaging at another end the first end of said helicoidal spring and being lifted, by a spring force transmitted by the first end of said helicoidal spring, into a position corresponding to the closed position of said valve tappet, with said valve tappet being displaced into its closed position by the spring force of the first end of said helicoidal spring transmitted by way of said push-button;

a spring-loaded flint having one end engaging the second end of said helicoidal sprig and an opposite end; and a sparking wheel mounted and means for mounting said wheel for rotation, by an external force, against the opposite end of said spring-loaded flint, the second end of said helicoidal spring being urged against the one end of said flint for pressing the opposite end of said flint against said sparking wheel.

2. A non-refillable lighter as defined in claim 1, and further comprising a member, made of dry powdered metal and having a gas throughput in accordance with a predetermined height of a flame, inserted in the flow channel of said burner body upstream of said mouth.

* * * * *